US005290343A

United States Patent [19]

Morita et al.

[11] Patent Number: 5,290,343

[45] Date of Patent: Mar. 1, 1994

[54] ELECTROSTATIC PRECIPITATOR MACHINE FOR CHARGING DUST PARTICLES CONTAINED IN AIR AND CAPTURING DUST PARTICLES WITH COULOMB FORCE

[75] Inventors: Keiichi Morita, Fujinomiya; Takeshi Sakai, Fuji, both of Japan

[73] Assignee: Kabushiki Kaisha Toshiba, Kawasaki, Japan

[21] Appl. No.: 911,615

[22] Filed: Jul. 10, 1992

[30] Foreign Application Priority Data

Jul. 19, 1991 [JP] Japan ..... 3-179924

[51] Int. Cl.[5] ..... B03C 3/12

[52] U.S. Cl. ..... 96/39; 96/68; 96/77; 96/83; 96/96; 96/99

[58] Field of Search ..... 55/113, 114, 131, 138, 55/149, 422, 428; 96/39, 40, 66, 77, 94, 68, 83, 96, 99

[56] References Cited

U.S. PATENT DOCUMENTS 3,735,560 5/1973 Wellman ..... 55/138 X
4,092,396 3/1992 Murano et al. ..... 55/269 X
4,133,653 1/1979 Soltis ..... 55/131 X
4,549,887 10/1985 Joannou ..... 55/131
4,976,753 12/1990 Huang ..... 55/131 X
5,060,717 10/1991 Morita et al. ..... 55/124 X

FOREIGN PATENT DOCUMENTS 55-22390 2/1980 Japan .

*Primary Examiner*—Richard L. Chiesa
*Attorney, Agent, or Firm*—Cushman, Darby & Cushman

[57] ABSTRACT

A first recess for detachably mounting an ionizer therethrough is formed to oppose a dust-collecting air suction side of a precipitator machine body. The ionizer includes an ionizing wire unit having an ionizing wire, and a counterelectrode plate, which can be detachably assembled. A second recess for detachably mounting a dust collector therethrough is formed to oppose a dust-collecting air discharge side of the precipitator body. The dust collector captures and collects dust particles, charged by the ionizer, with a Coulomb force. The ionizer and dust collector are simultaneously electrically connected to the body when they are mounted on the corresponding recesses.

13 Claims, 8 Drawing Sheets

ELECTROSTATIC PRECIPITATOR MACHINE FOR CHARGING DUST PARTICLES CONTAINED IN AIR AND CAPTURING DUST PARTICLES WITH COULOMB FORCE

BACKGROUND OF THE INVENTION

1. Field of the Invention

The present invention relates to an electrostatic precipitator machine for charging dust particles contained in air and capturing and collecting the charged dust particles with a Coulomb force.

2. Description of the Related Art

Electrostatic precipitator machines for capturing small dust particles contained in air to produce clean air have been recently proposed.

For example, Published Unexamined Japanese Patent Application No. 55-22390 discloses an electrostatic precipitator machine as shown in FIGS. 1A and 1B.

A front panel 102 is detachably mounted on a front opening 101 of a body casing 100.

A plurality of air intake ports 103 are formed in the front panel 102 to guide air containing dust particles into the body casing 100 therethrough.

An electrode plate unit 105 in which a plurality of electrode plates 104 are arranged at gaps is mounted on the front panel 102.

A plurality of discharge wires 106 are provided in the body casing 100 to alternate with the electrode plates 104.

When a high voltage is applied between the discharge wires 106 and the electrode plates 104, corona discharge occurs around the discharge wires 106 to generate ions.

The dust particles contained in the air guided through the air intake ports 103 collide with the ions to be charged.

The charged dust particles are attracted and collected by a dielectric filter 107 disposed behind the discharge wires 106 and the electrode plates 104.

The cleaned air passing through the dielectric filter 107 is discharged through an air discharge port 108 formed in the rear end portion of the body casing 100.

FIG. 1A shows a dust collecting state.

Air containing dust particles is guided to pass through the body casing 100 by rotation of a fan 110 mounted on a motor, and the dust particles are collected.

FIG. 1B shows a state in which the electrode plates 104 are cleaned.

Some of the charged dust particles attach to the electrode plates 104. If the electrode plates 104 are left uncleaned for a long period of time, dust is thickly deposited to cause clogging, thus degrading the dust collecting capability of the precipitator machine.

Thus, as shown in FIG. 1B, the front panel 102 on which the electrode plates 104 are mounted is removed from the body casing 100, as shown in FIG. 1B, to clean the electrode plates 104.

The electrostatic precipitator machine of this type, however, is generally installed at a high place of a room.

Although the front panel 102 is made of a synthetic resin material, it is heavy as it has a large area. The electrode plates 104 integral with the front panel 102 are also heavy as they are made of a metal material.

Accordingly, the total weight of the front panel 102 and the electrode plates 104 is very large.

To clean the electrode plates 104, the integral front panel 102 and electrode plates 104 must be removed and put down from the high location to the floor. When cleaning is completed, they must be lifted to the high location and mounted.

These operations require a large force and cumbersome procedures.

Since the dust particles attach to the discharge electrodes 106 as well, the discharge electrodes 106 must be cleaned.

However, since the discharge electrodes 106 are stationarily mounted on the body casing 100, the front panel 102 is removed and put down, and the discharge electrodes 106 are manually cleaned in the body casing 100.

If the body casing 100 is installed at a high place, this operation is dangerous. Even if it is installed at a low place, the operation also is very cumbersome.

SUMMARY OF THE INVENTION

The present invention has been made in view of the above situation, and has as its object to provide an electrostatic precipitator machine in which cleaning to remove captured dust particles can be easily performed even if the electrostatic precipitator machine is installed at a high place of the room, thereby constantly providing high dust collecting performance.

According to the present invention, there is provided an electrostatic precipitator machine for charging dust particles by ion discharge and capturing and collecting the dust particles with a Coulomb force, comprising:

- a body having a suction portion for guiding intake of air to be dust-collected and a discharge portion for guiding discharge of dust-collected air;
- first mounting means formed on the body to oppose the suction portion;
- second mounting means formed on the body to oppose the discharge portion;
- an ionizer detachably mounted on the first mounting means; and
- a dust collector detachably mounted on the second mounting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 2 to 12 show an electrostatic precipitator machine according to an embodiment of the present invention, in which FIG. 2 is a front view of an indoor unit of an air conditioner having the electrostatic precipitator machine, FIG. 3 is a perspective view of the indoor unit with its front panel being open, FIG. 4 is a longitudinal sectional view of the indoor unit, FIG. 5 is a front view of the indoor unit with its front panel being removed, FIG. 6 is an exploded perspective view of the electrostatic precipitator machine, FIG. 7 is a longitudinal sectional view of the electrostatic precipitator machine, FIG. 11 is a partially omitted front view of an ionizer mounted on the main body, and FIG. 12 is a view for explaining the electric connection and dust collecting operation of the electrostatic precipitator machine.

DETAILED DESCRIPTION OF THE PREFERRED EMBODIMENTS

Figure 1A:
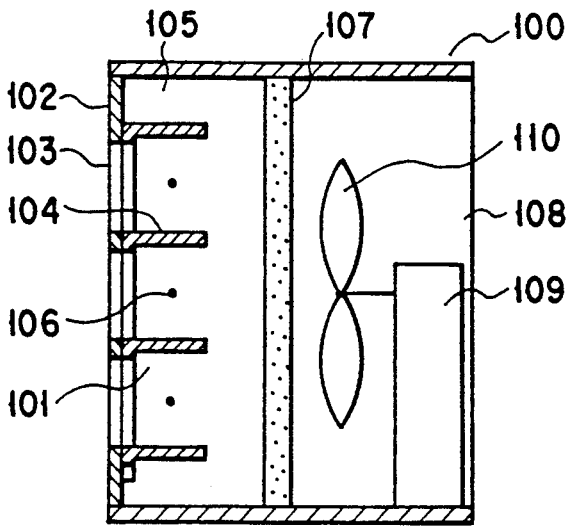
FIG. 1A (PRIOR ART)
FIG. 1A is a longitudinal sectional view of an electrostatic precipitator machine in the dust collecting state as a prior art of the present invention.
Figure 1B:
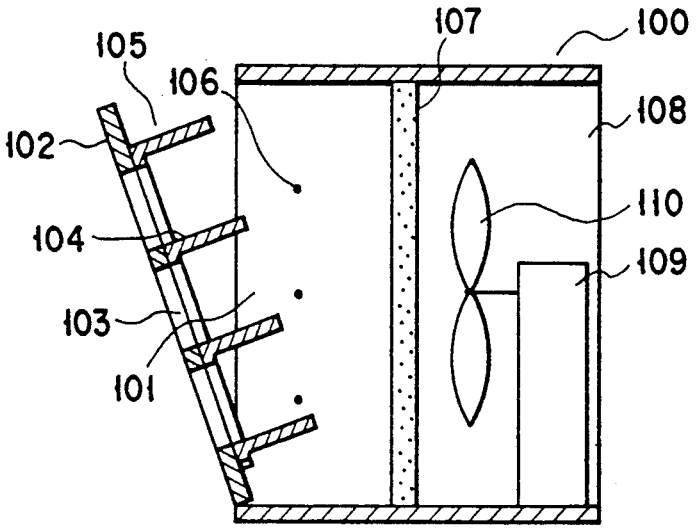
FIG. 1B (PRIOR ART)
FIG. 1B is a longitudinal sectional view of the electrostatic precipitator machine of FIG. 1A in the cleaning state.
Figure 2:
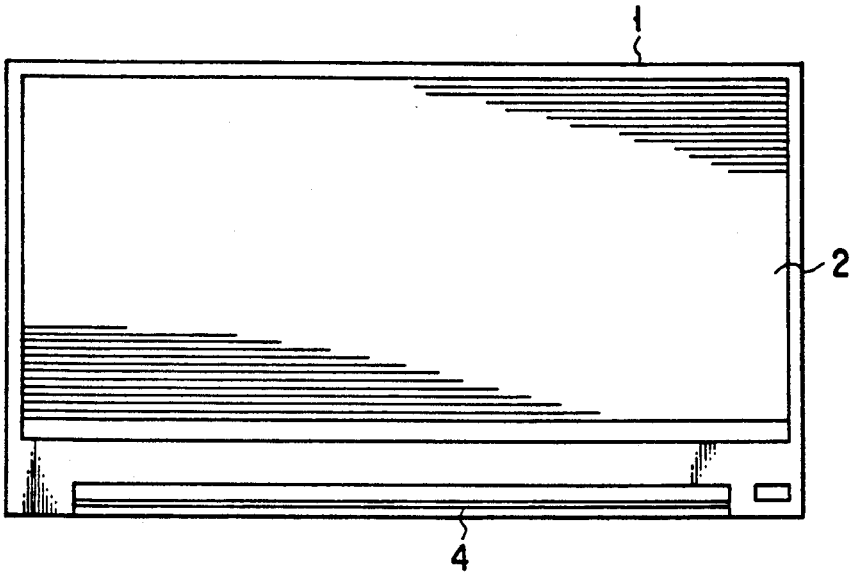

FIG. 2 is a front view of an indoor unit of an air conditioner having an electrostatic precipitator machine (to be described later) according to an embodiment of the present invention.

Figure 3:
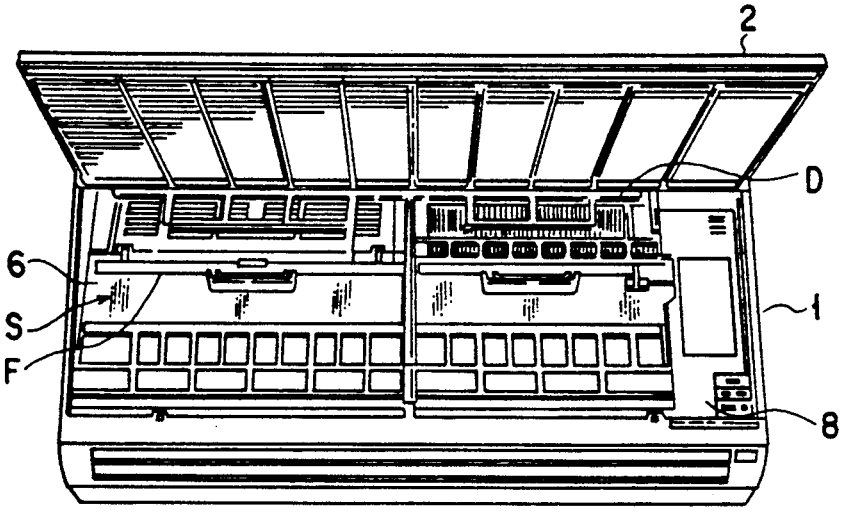
Figure 4:
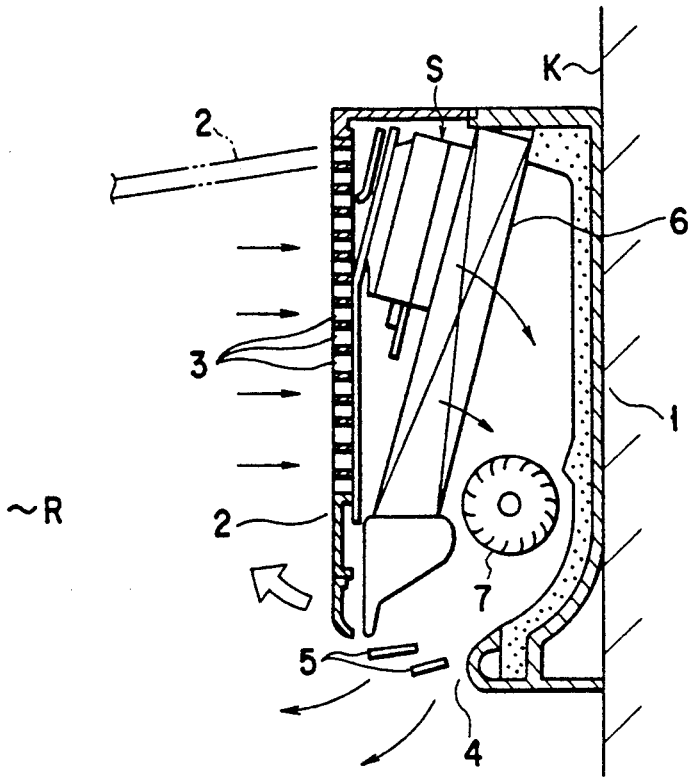

FIGS. 3 and 4 show the interior of the indoor unit.

The indoor unit has a rectangular box-shaped unit body 1 and is mounted on a wall K of a room R as a space to be air-conditioned.

A front panel 2 is mounted on the front surface of the unit body 1. The front panel 2 is supported on the body 1 to be pivotal about its upper end as the fulcrum.

When the lower end portion of the front panel 2 is pulled, the body 1 is opened.

A suction port 3 is formed in the front panel 2.

A supply port 4 is formed in the lower portion of the body 1. The supply port 4 has a louver 5 for changing the blowing direction.

A heat exchanger 6 is arranged in the body 1 such that its upper end is more tilted backward than its lower end.

A blower 7 is disposed in the lower portion behind the heat exchanger 6.

The blower 7 takes in air of the room R to be air-conditioned through the suction port 3, as indicated by arrows in FIG. 4, activates the heat exchanger 6 to perform heat exchange, and blows air to the room R to be air-conditioned through the supply port 4.

As shown in FIG. 3, a main frame F is provided in the unit body 1.

When the front panel 2 is open, it is apparent that an electrostatic precipitator machine S is arranged in the upper left portion of the main frame F and that a deodorizing filter D is arranged in the upper right portion of the main frame F.

Figure 5:
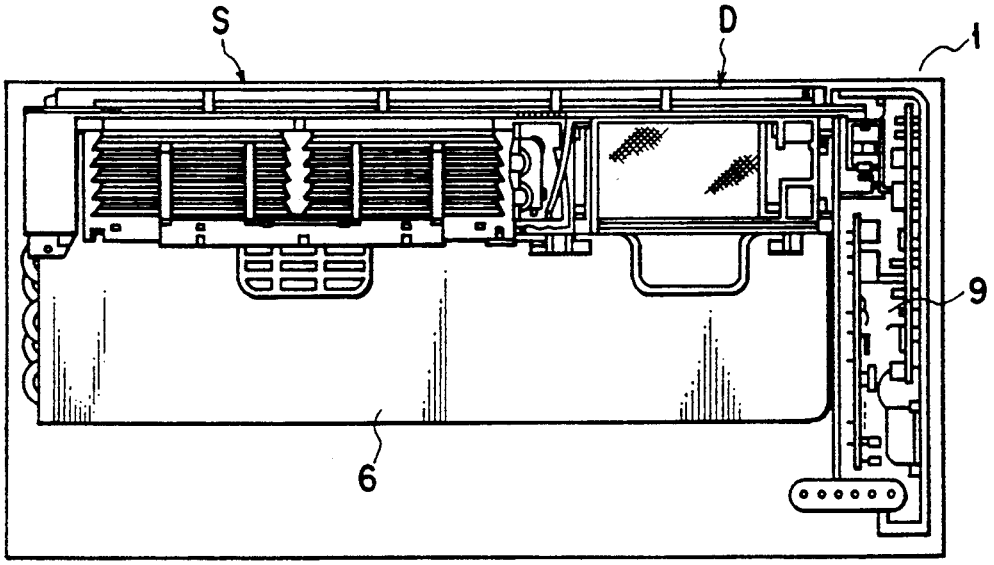

As shown in FIGS. 3 and 5, the upper portion of the heat exchanger 6 is covered with the electrostatic precipitator machine S and the deodorizing filter D, while its lower portion is exposed.

An electric component box 8 is provided in a side portion of the main frame F.

Electric control components 9 comprising a microcomputer are housed in the electric component box 8. The electric control components 9 control the electric operation of the unit body 1 and the electrostatic precipitator machine S.

Figure 6:
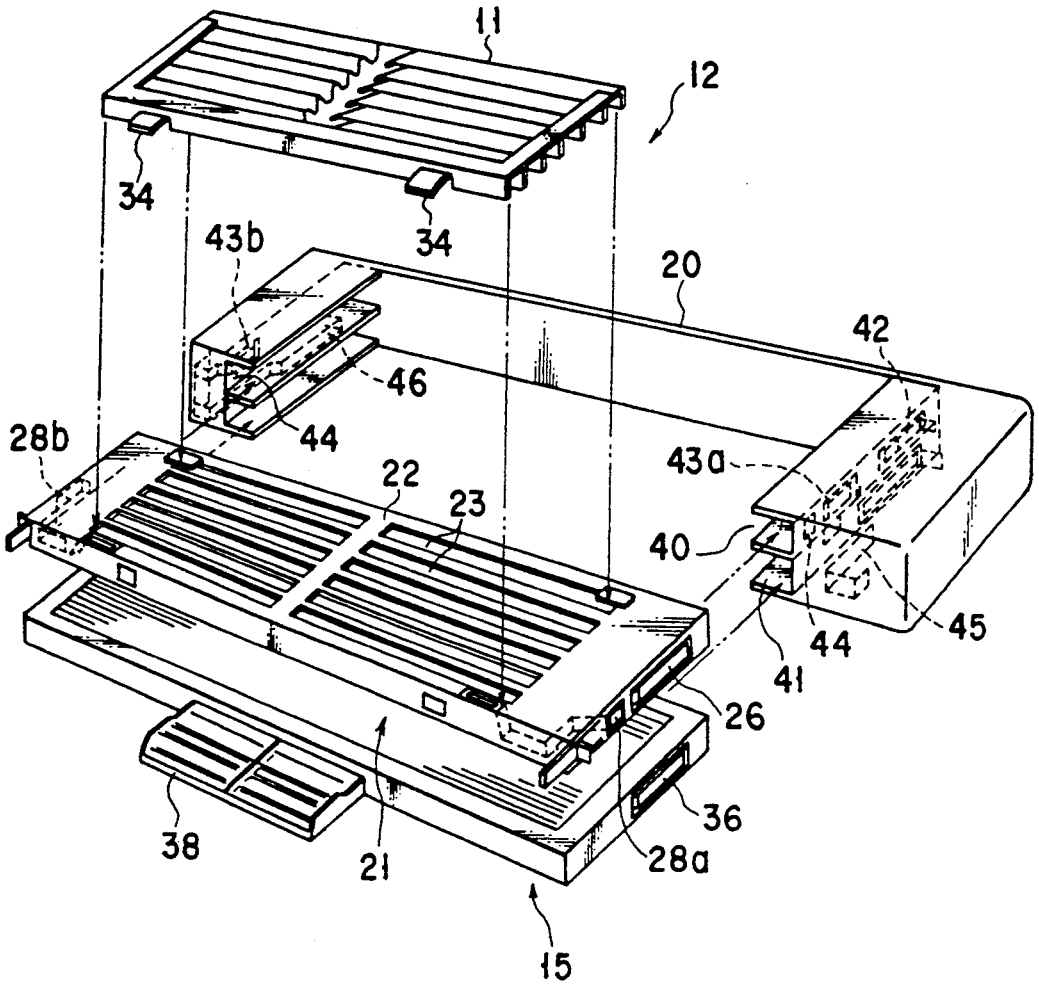
Figure 7:
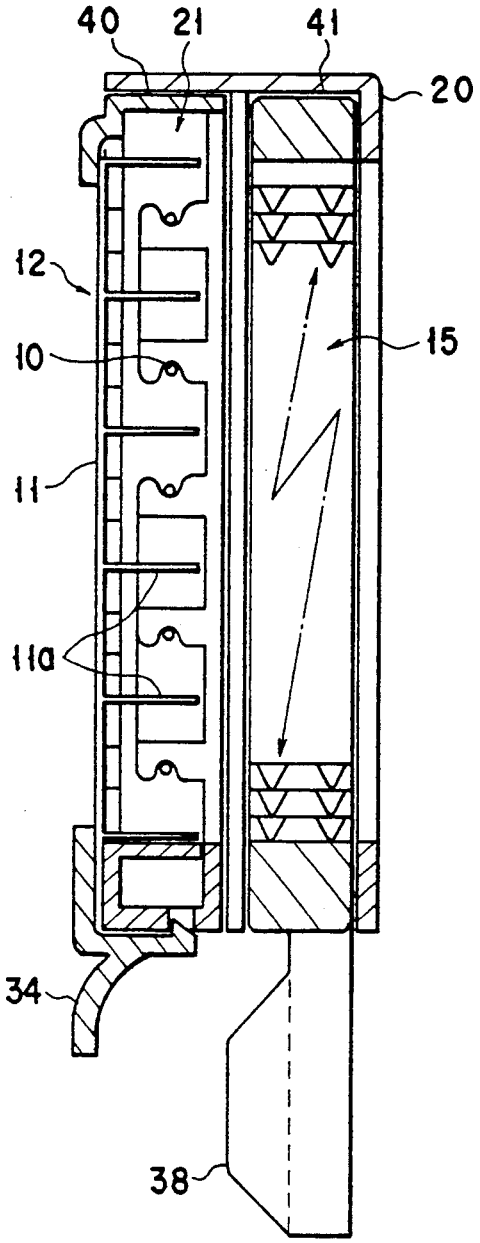

The electrostatic precipitator machine S has an arrangement as shown in FIGS. 6 and 7.

The electrostatic precipitator machine S is the precipitator machine body and constituted by a frame 20 having a mounting means (to be described later), and an ionizer 12 and a dust collector 15 which are detachably mounted on the frame 20.

The ionizer 12 has an ionizing wire unit 21 having a zigzag ionizing wire 10 serving as discharge electrodes, and a counterelectrode plate 11 detachably mounted on the ionizing wire unit 21.

Figure 8A:
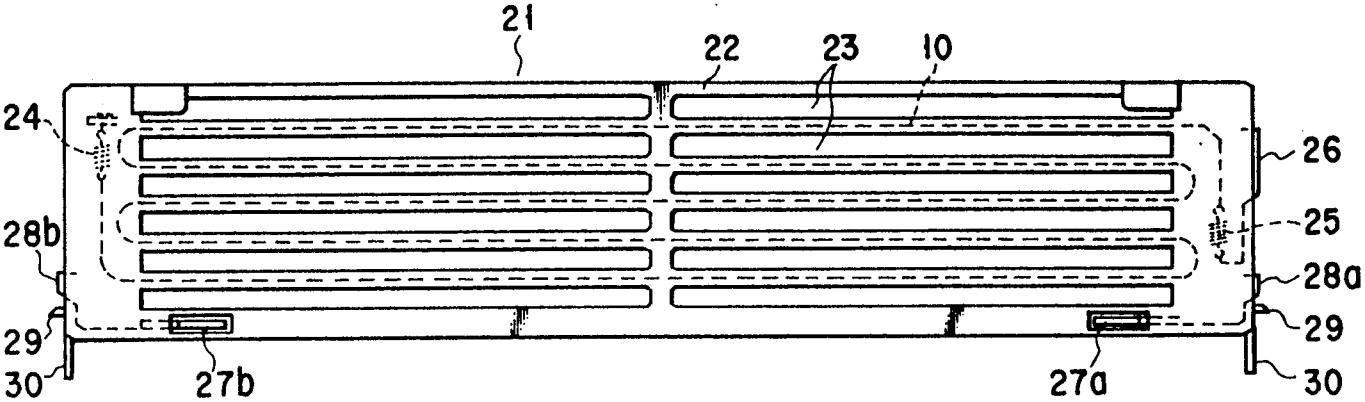
FIG. 8A is a front view of an ionizing wire unit.
Figure 8B:
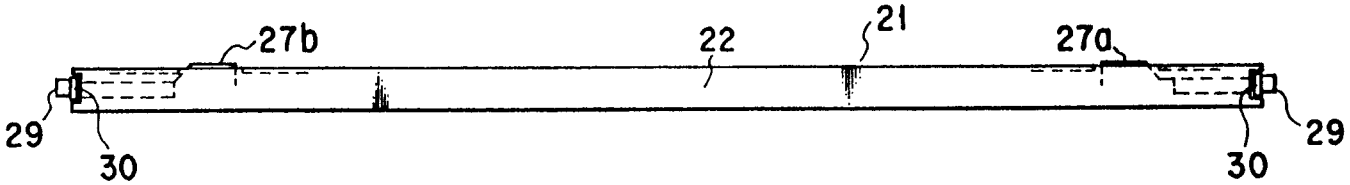
FIG. 8B is a bottom view of the ionizing wire unit.
Figure 8C:
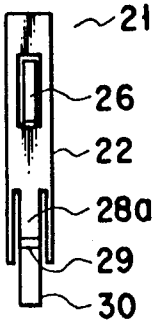
FIG. 8C is a side view of the ionizing wire unit.

FIGS. 8A, 8B, and 8C show the structure of the ionizing wire unit 21 in detail.

A plurality of elongated holes 23 are formed in the right and left portions of a rectangular upper frame 22 to be parallel with each other, excluding the two sides of the upper frame 22, at small gaps in the vertical direction.

The ionizing wire 10 is provided to oppose the remaining portions of the upper frame 22 alternating with the vertical elongated holes 23.

One end portion of the ionizing wire 10 is connected to one side portion of the upper frame 22 through a spring 24.

An intermediate portion of the ionizing wire 10 extends along the horizontal direction of the upper frame 22 to oppose the remaining portion of the upper frame 22, and the ionizing wire 10 is bent to form semicircular curves at two sides of the upper frame 22 alternately.

Accordingly, the ionizing wire 10 is disposed in a zigzag manner on the upper frame 22.

The other end portion of the ionizing wire 10 is connected to the other side portion of the upper frame 22 through a spring 25.

The spring 25 is bent such that part of it projects from the side surface of the upper frame 22, and is electrically connected to a first connection terminal 26 made of an elastic material.

A pair of ground terminals 27*a* and 27*b* project from the lower front portion of the upper frame 22 at two sides of the upper frame 22.

The ground terminals 27*a* and 27*b* are electrically connected to ground terminals 28*a* and 28*b* through leads in the upper frame 22.

The ground terminals 28*a* and 28*b* are made of an elastic material and bent to project from the two side surfaces of the upper frame 22.

In the vicinities of the ground terminals 28*a* and 28*b*, pawls 29 project from the same side surfaces, respectively.

Handles 30 are provided under the pawls 29 to project downward from the upper frame 22.

Figure 9A:
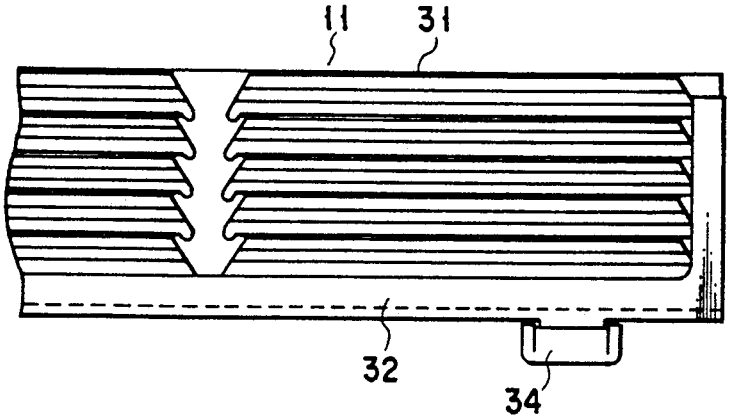
FIG. 9A is a partially omitted front view of a counterelectrode plate.
Figure 9B:
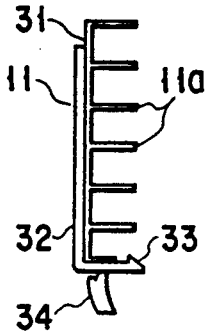
FIG. 9B is a side view of the counterelectrode plate.

FIGS. 9A and 9B show the structure of the counterelectrode plate 11 in detail.

The counterelectrode plate 11 has an ionizer frame 31 constituted by a metal plate, e.g., a stainless steel plate.

The ionizer frame 31 has a plurality of projecting pieces formed by cutting and bending at a constant pitch in the vertical direction to project to the same surface. These projecting pieces serve as electrode portions 11*a*.

An ionizer guard 32 overlaps the other surface of the ionizer frame 31 to cover its two side surfaces and lower end portion. The ionizer guard 32 and the ionizer frame 31 are fixed to each other.

The lower end portion of the ionizer guard 32 is bent toward the electrode portions 11*a*, and a pawl 33 is formed on the bent end portion of the ionizer guard 32.

Handles 34 are formed to project from the entire lower end face of the lower bent end portion of the ionizer guard 32.

Figure 10A:
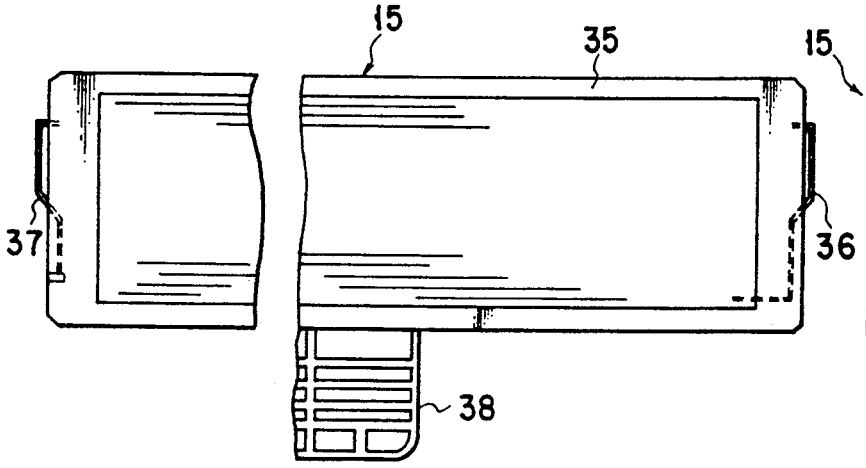
FIG. 10A is a partially omitted front view of a dust collector.
Figure 10B:
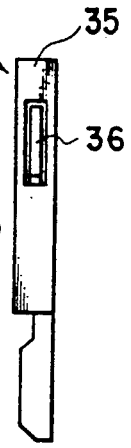
FIG. 10B is a side view of the dust collector.

FIGS. 10A and 10B show the structure of the dust collector 15 in detail.

The dust collector 15 has a rectangular frame member 35 formed to have substantially the same width and height as the ionizing wire unit 21.

A third connection terminal 36 made of an elastic material and bent is provided to project from one side portion of the frame member 35.

A ground terminal 37 made of an elastic material and bent is provided to project from the other side portion of the frame member 35.

A handle 38 is integrally provided on the lower end portion of the frame member 35.

As shown in FIG. 6, the frame 20 has a first recess 40 serving as a first mounting means to detachably mount the ionizing wire unit 21 on which the counterelectrode plate 11 is mounted.

The frame 20 additionally has a second recess 41 serving as a second mounting means to detachably mount the dust collector 15.

Each of the first and second recesses 40 and 41 comprises a pair of right and left recessed portions adjacent to each other in the front-and-back direction of the frame 20 and formed to have a central space intervened therebetween.

The lower end portions of the first and second recesses 40 and 41 are open to serve as the openings for mounting and detaching the ionizing wire unit 21, on which the counterelectrode plate 11 is mounted, and the dust collector 15, respectively.

The first recess 40 opposes the front panel 2 serving as the suction portion having suction ports 3.

The second recess 41 opposes the supply ports 4 serving as the discharge portion to discharge air from which dust has been removed.

A second connection terminal 42 is formed on one side surface of the first recess 40 to be electrically connected to a high-voltage unit (not shown) disposed in the unit body 1.

Ground terminals 43*a* and 43*b* grounded through the frame 20 are formed on the two side surfaces of the first recess 40. Fixing portions 44 are open in the vicinity of the ground terminals 43*a* and 43*b*.

A fourth connection terminal 45 is formed on one side surface of the second recess 43 to be electrically connected to a high-voltage unit (not shown) disposed in the unit body 1.

The second and fourth connection terminals 42 and 45 are connected to the high-voltage units for applying different high voltages, as will be described later.

A ground terminal 46 electrically connected to the ground terminal 43*b* of the first recess 40 in the frame 20 is formed on the other side surface of the second recess 41.

Figure 12:
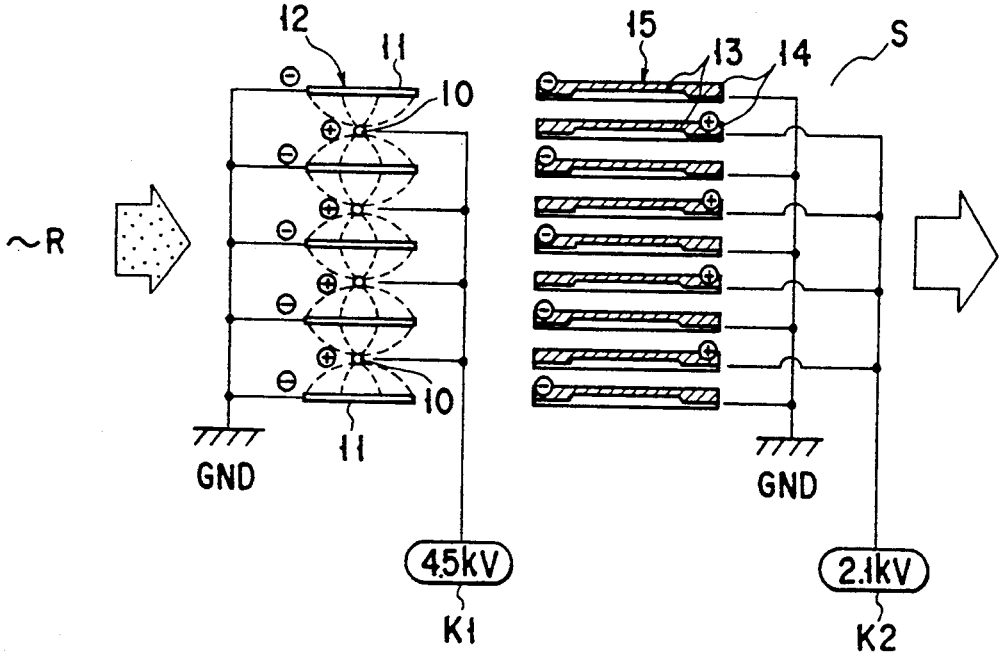

The electrostatic precipitator machine S has electrical connection as shown in FIG. 12.

The ionizing wire 10 serving as the discharge electrodes to constitute the ionizer 12 is connected to a high-voltage unit K1 which applies a high voltage of 4.5 kV to the electrodes. The counterelectrode plate 11 is grounded.

In the dust collector 15, a multiple of electrode sheets 14 each having a conductive layer 13 obtained by coating conductive coating are held at predetermined gaps.

The entire surface of each conductive layer 13 is covered with a semiconductor coating film.

The conductive layers 13 of the every other electrode sheets 14 are connected to a high-pressure unit K2 which applies a high voltage of 2.1 kV to the sheets. All the remaining conductive layers 13 are grounded.

Air in the room R to be air-conditioned is guided, as indicated by an arrow in FIG. 12, to the electrostatic precipitator machine S having the arrangement as described above. Dust particles are contained in air.

In the ionizer 12, a high voltage of 4.5 kV is applied to the ionizing wire 10 by the high-voltage unit K1 to perform ion discharge toward the counterelectrode plate 11.

Small dust particles contained in air passing through the electrode portions 11*a* of the counterelectrode plate 11 are ionized and positively charged.

Air containing the positively charged dust particles is guided to the dust collector 15 to pass through the respective electrode sheets 14.

A high voltage of 2.1 kV is applied to the dust collector 15 by the high-voltage unit K2.

Since the conductive layers 13 formed on the electrode sheets 14 are alternately connected to the positive and negative electrodes in units of the electrode sheets 14, a high-voltage electric field is formed between the conductive layers 13.

The positively charged dust particles are captured by the conductive layers 13 connected to the positive electrode with the Coulomb force generated by the dust collector 15, thereby performing dust collection.

Air obtained by the electrostatic precipitator machine S is cleaned and guided to the heat exchanger 6 to be heat-exchanged.

The electrostatic precipitator machine S is assembled in the manner as follows.

The end portions on the four sides of the counterelectrode plate 11 are detachably engaged with the corners of elongated holes 23 of the upper frame 22.

In this state, electrode portions 11*a* formed on the counterelectrode plate 11 by bending enter the elongated holes 23 of the upper frame 22 to interpose the ionizing wire 10 between the electrode portions 11*a*.

When the ionizing wire unit 21 on which the counterelectrode plate 11 is mounted is inserted in the first recess 40 of the frame 20, the pawls 29 of the ionizing wire unit 21 are engaged with the fixing portions 44 of the first recess 40 to position the ionizing wire unit 21.

Figure 11:
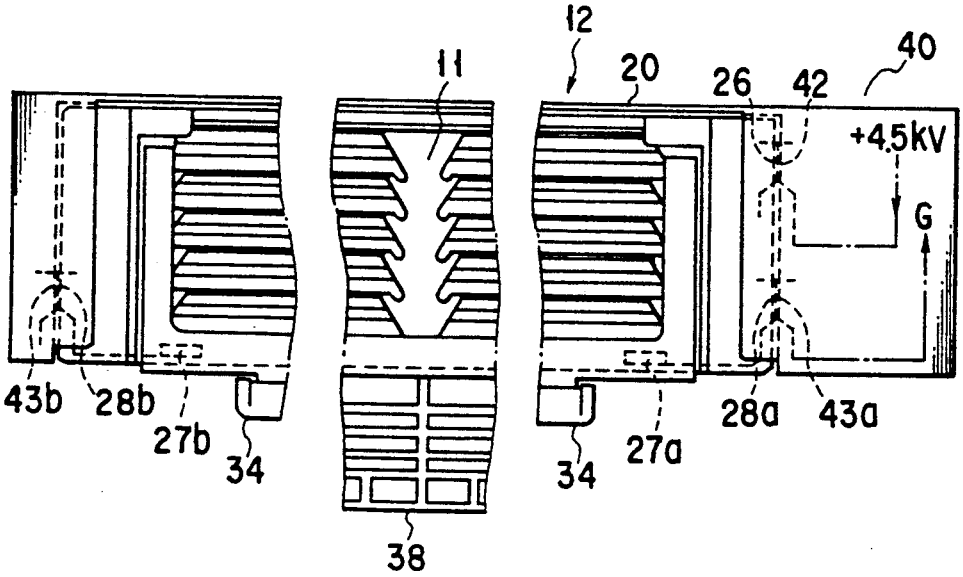

As shown in FIG. 11, the first connection terminal 26 projecting from the side face of the ionizing wire unit 21 abuts against the second connection terminal 42 of the first recess 40.

That is, the ionizing wire 10 is electrically connected to the high-voltage unit K1 having 4.5 kV shown in FIG. 12 through the first and second connection terminals 26 and 42.

As shown in FIG. 11, since the counterelectrode plate 11 is mounted on the ionizing wire unit 21, the counterelectrode plate 11 directly contacts the ground terminals 27*a* and 27*b* of the ionizing wire unit 21.

Furthermore, the ground terminals 28*a* and 28*b* projecting from the two side surfaces of the ionizing wire unit 21 are respectively connected to the ground terminals 43*a* and 43*b* of the first recess 40 to be grounded to the frame 20.

As is apparent from FIGS. 6 and 10, when the dust collector 15 is mounted on the second recess 41, the third connection terminal 36 projecting from the side surface of the dust collector 15 is connected to the fourth connection terminal 45 of the second recess 41.

That is, the conductive layers 13 of the dust collector 15 are electrically connected to the high-voltage unit K2 of 2.1 kV shown in FIG. 12 through the third and fourth connection terminals 36 and 45.

The ground terminal 37 of the dust collector 15 is electrically connected to the ground terminals 46 of the second recess 41.

Therefore, the dust collector 15 is grounded to the counterelectrode plate 15 by the ground terminals 37 and 46 through the ground terminals 43*a*, 28*b*, and 27*b*, and is then grounded to the frame 20 through the ground terminals 27*a*, 28*a*, and 43*a*.

Along with dust collection by the electrostatic precipitator machine S, air in the room R to be air-conditioned passes through the ionizer 12 and then passes through the dust collector 15.

Accordingly, dust removed from air attach not only to the dust collector 15 but also to the ionizer 12 and is accumulated after the air conditioner is operated for a certain period of time.

For example, dust particles having high insulating properties, e.g., sand, $SiO_2$, $Al_2O_3$, and alkalis sometimes attach to the counterelectrode plate 11 of the ionizer 12 to be accumulated.

Then, a so-called reverse ionizing phenomenon occurs in the counterelectrode plate 11 to accumulate positive ions on the surfaces of the dust particles, thereby causing back corona discharge toward the ionizing wire 10.

The electric field is disturbed by the back corona discharge to locally increase the intensity of the electric field.

The ionizing wire 10 resonates to repeatedly move close to the counterelectrode plate 11. By this behavior of the ionizing wire 10, spark discharge occurs intermittently to occasionally disconnect the ionizing wire 10.

In the present invention, the ionizer 12 can be mounted on and detached from the frame 20 as the main body of the electrostatic precipitator machine S.

In addition, the ionizing wire unit 21 constituting the ionizer 12 and the counterelectrode plate 11 can be detachably mounted on each other.

Therefore, when dust accumulation is started on the ionizing wire unit 21 and the counterelectrode plate 11, the ionizing wire unit 21 and the counterelectrode plate 11 can be removed from the frame 20 and cleaned.

In the present invention, the dust collector 15 can be detachably mounted on the frame 20.

Therefore, when dust accumulation is started on the dust collector 15, the dust collector 15 can be removed from the frame 20 and cleaned.

The cleaning operation is ideally performed periodically.

More specifically, the cleaning operation is performed in the manner as described as follows.

That is, dust collection is temporarily stopped, the front panel 2 is held open, and the ionizer 12 is removed from the first recess 40.

At this time, the counterelectrode plate 11 and the ionizing wire unit 21 constituting the ionizer 12 are kept integrally mounted on each other.

The handles 34 provided on the lower end portion of the counterelectrode plate 11 can be grabbed easily as they extend downward from the lower surface opening of the first recess 40.

The ionizer 12 can be removed by pulling the handles 34 downward.

Therefore, even if the indoor unit body 1 incorporating the electrostatic precipitator machine S is installed at a high place, the ionizer 12 can be removed very easily.

The removed ionizer 12 is disassembled into the ionizing wire unit 21 and the counterelectrode plate 11 at an appropriate place.

Since the ionizing wire 10 and the electrode portions 11*a* are exposed from the ionizing wire unit 21 and the counterelectrode plate 11, respectively, they are cleaned to get rid of dust attaching to them.

The dust collector 15 may also be preferably removed from the second recess 41.

The handle 38 formed on the lower end portion of the dust collector 15 can be easily held since it projects downward from the lower surface opening of the second recess 41.

In this state, the handle 38 is pulled down to remove the dust collector 15.

Accordingly, even if the indoor unit body 1 incorporating the electrostatic precipitator machine S is mounted at a high place, the dust collector 15 can be removed very easily.

The removed dust collector 15 is cleaned to get rid of dust attaching to it.

After the cleaning operation is completed, the counterelectrode plate 11 is mounted on the ionizing wire unit 21 to assemble the ionizer 12, and the ionizer 12 is pushed up by grabbing the handles 34 such that the upper end portion of the ionizer 12 opposes the lower surface opening of the first recess 41.

When the ionizer 12 is pushed up by a predetermined amount, it is automatically mounted on the first recess 40.

Simultaneously, the first connection terminal 26 projecting from the side end portion of the ionizing wire unit 21 is electrically connected to the second connection terminal 42 of the first recess 40 to obtain electrical connection.

To mount the dust collector 15, it is pushed up by grabbing the handle 38 such that the upper end portion of the dust collector 15 opposes the lower surface opening of the first recess 41.

When the dust collector 15 is pushed up by a predetermined amount, it is automatically mounted on the second recess 41.

Simultaneously, the third connection terminal 36 projecting from the side end portion of the dust collector 15 is electrically connected to the fourth connection terminal 45 provided on the second recess 41 to obtain electrical connection.

As a result, when the ionizer 12 and the dust collector 15 are mounted in the first and second recesses 40 and 41, respectively, the dust collecting operation can be resumed at once.

The above embodiment exemplifies an electrostatic precipitator machine incorporated in an air conditioner. However, the present invention is not limited to this, and the present invention can be applied to an independent electrostatic precipitator machine.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrostatic precipitator apparatus, comprising:

a body having a suction portion for guiding intake of air, having dust particles therein, and a discharge portion for guiding discharge of said air from said body;

an ionizer for charging said dust particles, including:

an ionizing wire unit having an ionizing wire;

a counterelectrode plate detachably mounted to said ionizing wire unit and comprising electrode portions; and a first terminal disposed thereon and electrically coupled to said ionizing wire;

a dust collector for generating a Coulomb force to collect said charged dust particles;

first mounting means, proximate to said suction portion, for removably mounting said ionizer to said body, comprising a second terminal electrically coupled to said body, said second terminal automatically electrically coupling to said first terminal when said ionizer is mounted to said body; and second mounting means, proximate to said discharge portion, for removably mounting said dust collector to said body.

2. An apparatus according to claim 1, wherein:

said ionizing wire unit comprises a frame having a plurality of holes for allowing said air to pass therethrough; and said ionizing wire is disposed in a zigzag manner between adjacent said holes.

3. An apparatus according to claim 2, wherein said ionizing wire is interposed between said electrode portions of said counter electrode plate when said counterelectrode plate mounts on said ionizing wire unit.

4. An apparatus according to claim 1, wherein said counterelectrode plate further comprises:

an ionizer frame, having first and second surfaces and a plurality of said electrode portions projecting from said first surface, for allowing said air to pass therebetween; and an ionizer guard covering a portion of said second surface of said ionizer frame.

5. An apparatus according to claim 1, wherein said dust collector comprises positively and negatively charged conductive layers, alternately disposed at predetermined distances from each other, for generating said Coulomb force.

6. An apparatus according to claim 5, wherein:

said dust collector comprises a third surface having a third terminal disposed thereon and electrically coupled to said conductive layers; and said second mounting means comprises a fourth surface having a fourth terminal electrically disposed thereon and electrically coupled to said body, said third and fourth terminals electrically coupling to each other when said dust collector is mounted to said body.

7. An apparatus according to claim 6, wherein said dust collector has a first surface having said third terminal disposed thereon, and said second mounting means has a second surface having said fourth terminal disposed thereon and opposing said first surface when said dust collector is mounted to said body, and at least one of said third and fourth terminals comprises elastic material.

8. An apparatus according to claim 1, wherein said first mounting means comprises a pair of recessed portions for detachably engaging corresponding portions of said ionizer.

9. An apparatus according to claim 1, wherein said second mounting means comprises a pair of recessed portions for detachably engaging corresponding portions of said dust collector.

10. An apparatus according to claim 1, wherein said first and second mounting means have surfaces defining openings for receiving said ionizer and said dust collector, respectively, therein.

11. An apparatus according to claim 10, wherein said ionizer and said dust collector each comprises handles for facilitating mounting and unmounting thereof to said body.

12. An apparatus according to claim 1, wherein said ionizing wire unit has a first surface having said first terminal disposed thereon, and said first mounting means has a second surface having said second terminal disposed thereon and opposing said first surface when said ionizer is mounted to said body, and at least one of said first and second terminals comprises elastic material.

13. An apparatus according to claim 1, wherein said body further comprises means for applying high voltages of different values to said ionizer and said dust collector when said ionizer and said dust collector are mounted to said body.

* * * * *